US009502745B2

(12) United States Patent
Hirayama

(10) Patent No.: US 9,502,745 B2
(45) Date of Patent: Nov. 22, 2016

(54) FLEXIBLE SUBSTRATE HAVING A MICROSTRIP LINE CONNECTED TO A CONNECTION PORTION WITH A SPECIFIED CONDUCTOR PATTERN

(71) Applicant: Sumitomo Electric Device Innovations, Inc., Yokohama-shi (JP)

(72) Inventor: Masahiro Hirayama, Yokohama (JP)

(73) Assignee: Sumitomo Electric Device Innovations, Inc., Yokohama-shi (JP)

( * ) Notice: Subject to any disclaimer, the term of this patent is extended or adjusted under 35 U.S.C. 154(b) by 0 days.

(21) Appl. No.: 14/339,033

(22) Filed: Jul. 23, 2014

(65) Prior Publication Data

US 2015/0028971 A1 Jan. 29, 2015

(30) Foreign Application Priority Data

Jul. 24, 2013 (JP) ..... 2013-153980

(51) Int. Cl.
*H01P 5/02* (2006.01)
*H01P 3/00* (2006.01)
*H01P 1/04* (2006.01)

(52) U.S. Cl.
CPC ..... *H01P 5/028* (2013.01); *H01P 1/047* (2013.01); *H01P 3/006* (2013.01)

(58) Field of Classification Search
CPC ..... H01P 1/047; H01P 3/006; H01P 5/028
USPC ..... 333/246, 260, 34
See application file for complete search history.

(56) References Cited

U.S. PATENT DOCUMENTS 5,631,446 A * 5/1997 Quan ..... H01R 12/62 174/254
7,696,628 B2 * 4/2010 Ikeuchi ..... H01P 1/047 257/775
8,044,746 B2 * 10/2011 Blair ..... H01P 3/006 333/247
2005/0116792 A1 * 6/2005 Moon ..... H01P 3/003 333/161

FOREIGN PATENT DOCUMENTS

JP 2011-238883 A 11/2011

* cited by examiner

*Primary Examiner* — Benny Lee
(74) *Attorney, Agent, or Firm* — Venable LLP; Michael A. Sartori; Trent B. Ostler

(57) ABSTRACT

A flexible substrate is disclosed. The flexible substrate includes an insulating substrate having a first surface and a second surface opposite to the first surface, a first connection portion having a first conductor, a first ground pattern, and a second ground pattern on the first surface, the first ground pattern and the second ground pattern being spaced apart from the first conductor and respectively located at either side of the first conductor, a conductor pattern formed on the second surface, the conductor pattern being connected to the first conductor, and a third ground pattern formed on the second surface, the third ground pattern being connected to the first ground pattern, wherein a distance between the conductor pattern and the third ground pattern is smaller than a distance between the first conductor and the first ground pattern.

19 Claims, 6 Drawing Sheets

FLEXIBLE SUBSTRATE HAVING A MICROSTRIP LINE CONNECTED TO A CONNECTION PORTION WITH A SPECIFIED CONDUCTOR PATTERN

FIELD

The present invention relates to a flexible substrate and an optical device.

BACKGROUND

A flexible substrate is used for connection between electronic circuits (Refer to Japanese Patent Laid-Open Publication No. 2011-238883). In the flexible substrate, a transmission line such as a coplanar line for transferring a high frequency signal is provided. The coplanar line is formed by a signal line and ground patterns located at either side of the signal line.

SUMMARY OF THE INVENTION

A characteristic impedance of a coplanar line is determined by a distance between a signal line and a ground pattern, the widths of the signal line and the ground pattern or the like. Sometimes, the characteristic impedance may deviate from a desired value according to the distance and the widths. An aspect of the present invention is to provide a flexible substrate including a coplanar line having a desired characteristic impedance.

An aspect of the present invention relates to a flexible substrate including: an insulating substrate having a first surface and a second surface opposite to the first surface, the insulating substrate including resin; a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor; a conductor pattern formed on the second surface, the conductor pattern being connected to the first conductor through a first via wire which passes through the insulating substrate; and a third ground pattern formed on the second surface, the third ground pattern being connected to the first ground pattern through a second via wire which passes through the insulating substrate, wherein a distance between the conductor pattern and the third ground pattern is smaller than a distance between the first conductor and the first ground pattern.

An aspect of the present invention relates to an optical device including: a flexible substrate including an insulating substrate having a first surface and a second surface opposite to the first surface, the insulating substrate including resin, a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor, a conductor pattern formed on the second surface, the conductor pattern being connected to the first conductor through a first via wire which passes through the insulating substrate, and a third ground pattern formed on the second surface, the third ground pattern being connected to the first ground pattern through a second via wire which passes through the insulating substrate, wherein a distance between the conductor pattern and the third ground pattern is smaller than a distance between the first conductor and the first ground pattern; a housing including an optical element; a receptacle connected to the housing; and a lead pin configured to connect the housing and the flexible substrate.

DETAILED DESCRIPTION OF THE INVENTION

Description of Embodiments

Figure 1A:
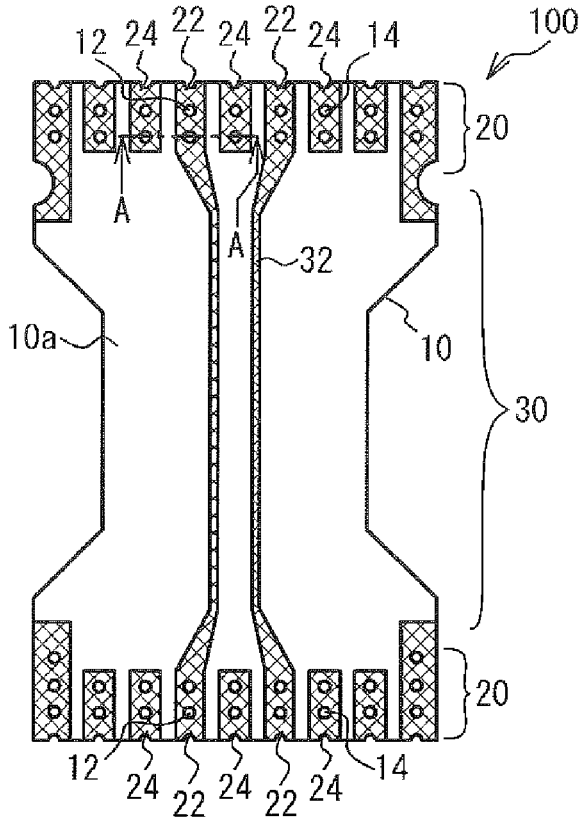
FIG. 1A is a plan view illustrating a first surface of a flexible substrate according to a first embodiment.

First of all, embodiments of the invention of the subject application will be described as enumerated below.

One embodiment of the present invention is a flexible substrate including: an insulating substrate having a first surface and a second surface opposite to the first surface, the insulating substrate including resin; a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor; a conductor pattern formed on the second surface, the conductor pattern being connected to the first conductor through a first via wire which passes through the insulating substrate; and a third ground pattern formed on the second surface, the third ground pattern being connected to the first ground pattern through a second via wire which passes through the insulating substrate, wherein a distance between the conductor pattern and the third ground pattern is smaller than a distance between the first conductor and the first ground pattern.

In the above configuration, the width of the conductor pattern may be wider than the width of the first conductor.

In the above configuration, the width of the third ground pattern may be wider than the width of the first ground pattern.

In the above configuration, the first conductor may be connected to a first electrode of the external conductor, and the first ground pattern may be connected to a second electrode of the external conductor.

In the above configuration, the flexible substrate may further comprise a microstrip line including a line conductor on the first surface of the insulating substrate and a fourth ground pattern on the second surface of the insulating substrate, wherein the line conductor is connected to the first conductor.

In the above configuration, the flexible substrate may further comprise a second connection portion having a second conductor, the second ground pattern, and a fifth ground pattern on the first substrate, wherein the second ground pattern and the fifth ground pattern is spaced apart from the second conductor and respectively located at either side of the second conductor, and wherein the second ground pattern is located between the first conductor and the second conductor.

In the above configuration, the first conductor may have an end portion whose width is wider than a width of a middle portion of the first conductor.

In the above configuration, the second conductor may have an end portion whose width is wider than a width of a middle portion of the second conductor.

In the above configuration, a first coplanar line may be constituted by the first conductor, the first ground pattern, and the second ground pattern.

In the above configuration, the third ground pattern may be connected to the second ground pattern through a third via wire which passes through the insulating substrate.

In the above configuration, a second coplanar line may be constituted by the second conductor, the second ground pattern, and the fifth ground pattern.

Another one embodiment of the present invention is an optical device including: a flexible substrate including an insulating substrate having a first surface and a second surface opposite to the first surface, the insulating substrate including resin, a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor, a conductor pattern formed on the second surface, the conductor pattern being connected to the first conductor through a first via wire which passes through the insulating substrate, and a third ground pattern formed on the second surface, the third ground pattern being connected to the first ground pattern through a second via wire which passes through the insulating substrate, wherein a distance between the conductor pattern and the third ground pattern is smaller than a distance between the first conductor and the first ground pattern; a housing including an optical element; a receptacle connected to the housing; and a lead pin configured to connect the housing and the flexible substrate.

Details of Embodiments

Specific examples of the flexible substrate according to embodiments of the present invention and of the optical device according to an embodiment of the present invention will be described below with reference to the accompanying drawings. It should be noted that the present invention is not limited to these examples but shown in the claims, and it is intended that all modifications that come within the meaning and range of equivalence to the claims should be embraced herein. In the description, the same elements or elements having the same function are denoted with the same reference signs, and an overlapping description will be omitted.

First Embodiment

Figure 1B:
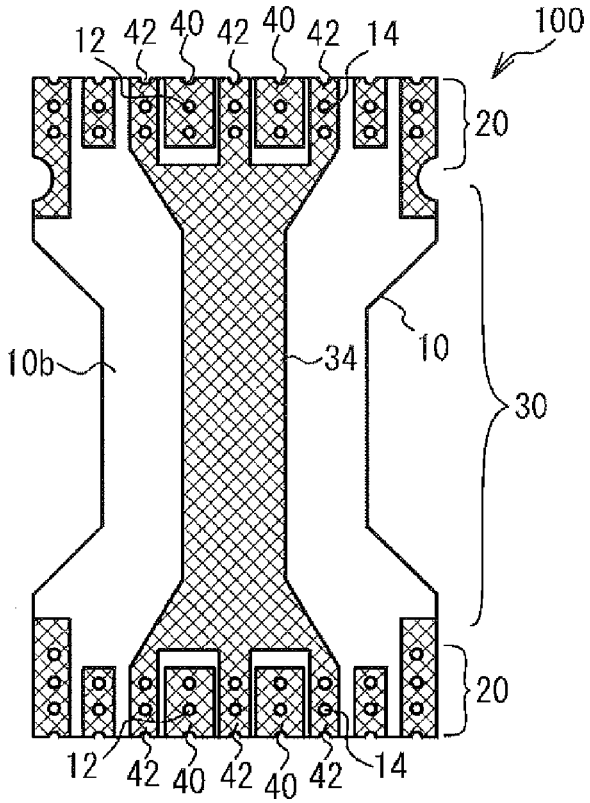
FIG. 1B is a plan view illustrating a second surface of the flexible substrate according to a first embodiment.
Figure 2A:
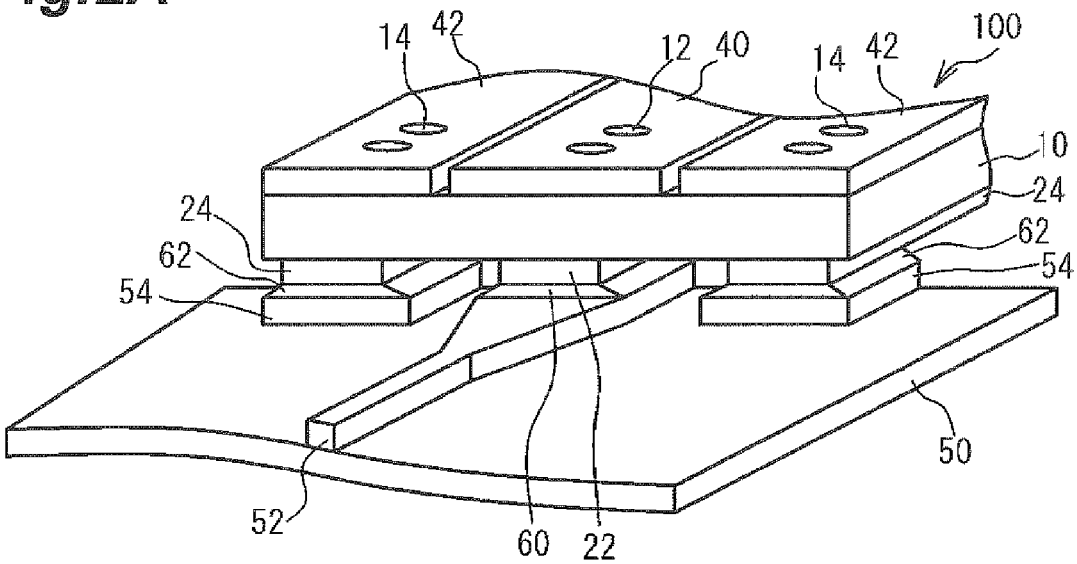
FIG. 2A is a perspective view illustrating connection between a wiring substrate and a flexible substrate according to a first embodiment.
Figure 2B:
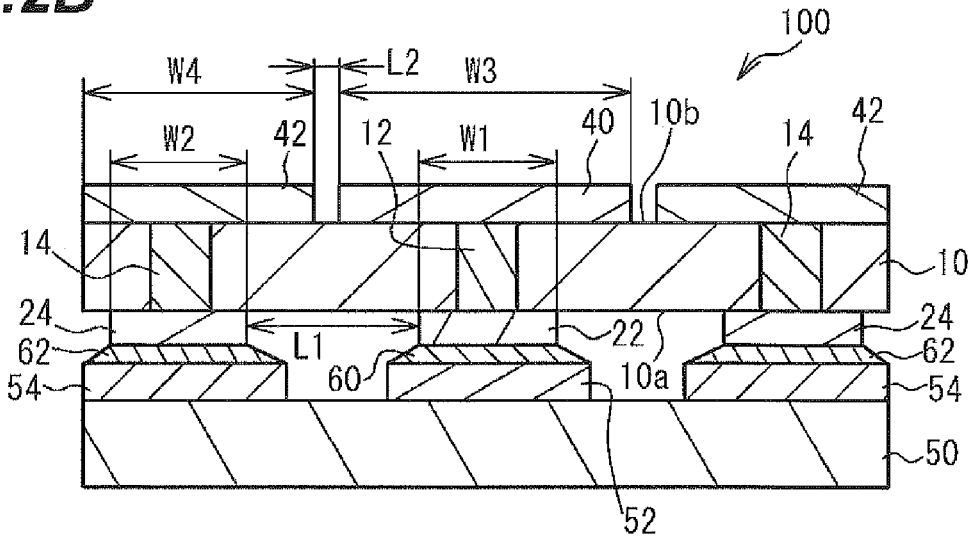
FIG. 2B is a sectional view taken along line A-A of FIG. 1A.

The first embodiment is an example where a width of a connection pattern 40 connected to a signal line 22 is wider than a width of the signal line 22, and a distance between the connection pattern 40 and a ground pattern 42 is smaller than a distance between the signal line 22 and a ground pattern 24. FIG. 1A is a plan view illustrating a first surface 10*a* of a flexible substrate 100 according to a first embodiment. FIG. 1B is a plan view illustrating a second surface 10*b* of the flexible substrate 100. FIG. 2A is a perspective view illustrating the connection between the flexible substrate 100 and a wiring substrate 50. FIG. 2B is a sectional view taken along line A-A of FIG. 1A.

As shown in FIGS. 1A and 1B, the flexible substrate 100 includes an insulating substrate 10, a coplanar line 20, and a microstrip line 30. Two coplanar lines 20 are provided on the upper side in a longitudinal direction of the flexible substrate 100 and two coplanar lines 20 are provided on the lower side in the longitudinal direction thereof. The microstrip line 30 connects the coplanar lines 20 provided on the upper side and the lower side of the flexible substrate 100, to each other. A high frequency signal input to one of the coplanar lines 20 is transmitted via the microstrip line 30, and is output from the other one of the coplanar lines 20. As shown in FIGS. 2A and 2B, the first surface 10*a* (FIGS. 1A, 1B) of the flexible substrate 100 faces the wiring substrate 50, the signal line 22 of the coplanar line 20 (FIGS. 1A, 1B) is connected to a signal line 52 of the wiring substrate 50, and ground patterns 24 of the coplanar line 20 are connected to a ground pads 54 of the wiring substrate 50. A detailed configuration thereof will be described below.

As shown in FIGS. 1A and 2B, the coplanar line 20 (FIG. 1A) has the signal lines 22 and the ground patterns 24. As shown in FIGS. 1A and 1B, the microstrip line 30 has a signal line 32 and a ground pattern 34. As shown in FIG. 1A, the signal lines 22 and 32 and the ground patterns 24 are provided on the first surface 10*a* of the insulating substrate 10. The signal line 22 and the signal line 32 are connected to each other, and for example, are formed integrally. The ground patterns 24 and the signal line 22 are spaced apart from each other, and the ground patterns 24 are located at opposite sides of the signal line 22.

As shown in FIG. 1B, the ground patterns 34 and 42 and the conductor pattern 40 are provided on the second surface 10*b* opposite to the first surface 10*a* of the insulating substrate 10. The conductor pattern 40 and the ground patterns 42 are spaced apart from each other. The ground patterns 34 and 42 are connected to each other, and for example, are formed integrally. As shown in FIG. 2B, the signal line 22 and the conductor pattern 40 are electrically connected to each other through a via wire 12 passing through the insulating substrate 10. The ground pattern 24 and the ground pattern 42 are electrically connected to each other through a via wire 14 passing through the insulating substrate 10. The insulating substrate 10 is formed of resin such as polyamide or the like. The signal lines 22 and 32, the ground patterns 24, 34 and 42, and the conductor pattern 40 are formed of a metal such as gold (Au) or the like. The via wires 12 and 14 are formed of a metal such as copper (Cu) or the like.

The width W1 of the signal line 22 and the width W2 of the ground pattern 24 may be made to be narrow. The flexible substrate 100 can be made to be small by making the widths W1 and W2 narrow. Further, as will be described below, bond strength between the flexible substrate 100 and the wiring substrate 50 can be improved.

As shown in FIGS. 2A and 2B, the signal line 22 is electrically connected to the signal line 52 of the wiring substrate 50 using a brazing material 60 (brazing filler metal). The ground patterns 24 are electrically connected to the ground pads 54 of the wiring substrate 50 using a brazing material 62, respectively. For example, the brazing materials 60 and 62 correspond to a solder of which the main component is Tin-Silver (Sn—Ag) or the like. As shown in FIG. 2B, the width W1 of the signal line 22 is narrower than the width of the signal line 52. Accordingly, the brazing material 60 has a tapered shape of which the end is tapered toward the upper portion thereof. The width W2 of the ground pattern 24 is narrower than a width of the ground pad 54. Accordingly, the brazing material 62 has a tapered shape, similar to the brazing material 60. Therefore, bond strength between the flexible substrate 100 and the wiring substrate 50 is improved.

A characteristic impedance of the coplanar line 20 is changed according to dimensions of the signal line 22 and the ground patterns 24. In the comparative example described later, when the widths of the signal line 22 and the ground pattern 24 are narrowed, the characteristic impedance is increased. In contrast, according to the first embodiment, the characteristic impedance can be decreased as will be described below. As shown in FIG. 2B, the width W3 of the conductor pattern 40 is wider than the width W1, and is equal to, for example, 0.7 mm. A width W4 of the ground pattern 42 is wider than the width W2. A distance L1 is set between the signal line 22 and the ground pattern 24, and a distance L2 is set between the conductor pattern 40 and the ground pattern 42. The distance L2 is smaller than the distance L1, and is equal to, for example, 0.1 mm. The width W3 is wider than the width W1 and the distance L2 is smaller than the distance L1, so that even when the widths W1 and W2 are narrower than the width W3, the characteristic impedance of the coplanar line 20 is decreased. For example, the characteristic impedance may have a desired value such as 50Ω. That is, according to the first embodiment, the desired characteristic impedance can be achieved and the bond strength can be improved at the same time.

As shown in FIGS. 1A and 1B, the coplanar line 20 is connected to the microstrip line 30. The characteristic impedance of the coplanar line 20 may be matched with the characteristic impedance of the microstrip line 30.

The two coplanar lines 20 provided on the upper side and the lower side of the flexible substrate 100 function as a differential transmission line. In the two coplanar lines 20 which are adjacent to each other, the ground pattern 24 between the signal lines 22 correspond to a common component. The flexible substrate 100 may be miniaturized by commonly using the ground pattern 24. The two signal lines 22 are provided to be symmetric with respect to a central line of the commoditized ground pattern 24. Accordingly, a phase characteristic between the differential signals can be improved.

Figure 3A:
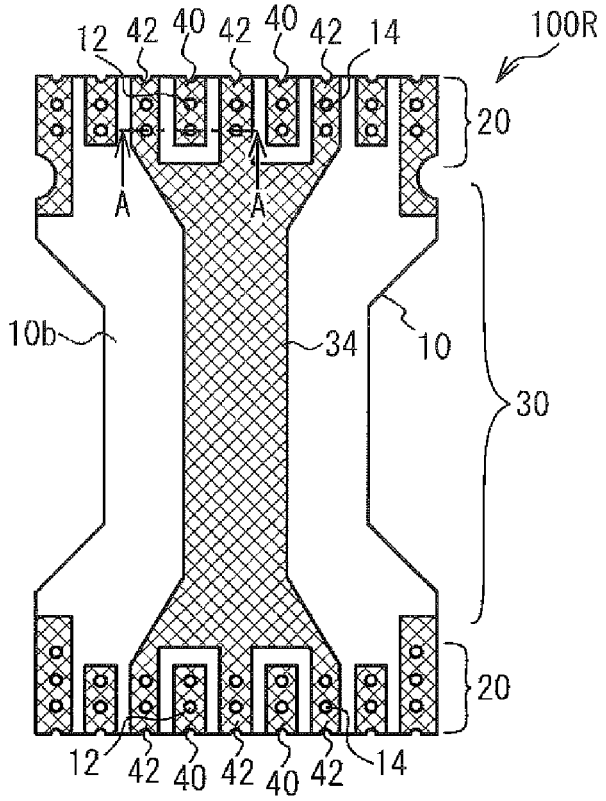
FIG. 3A is a plan view illustrating a second surface of a flexible substrate according to a comparative example.
Figure 3B:
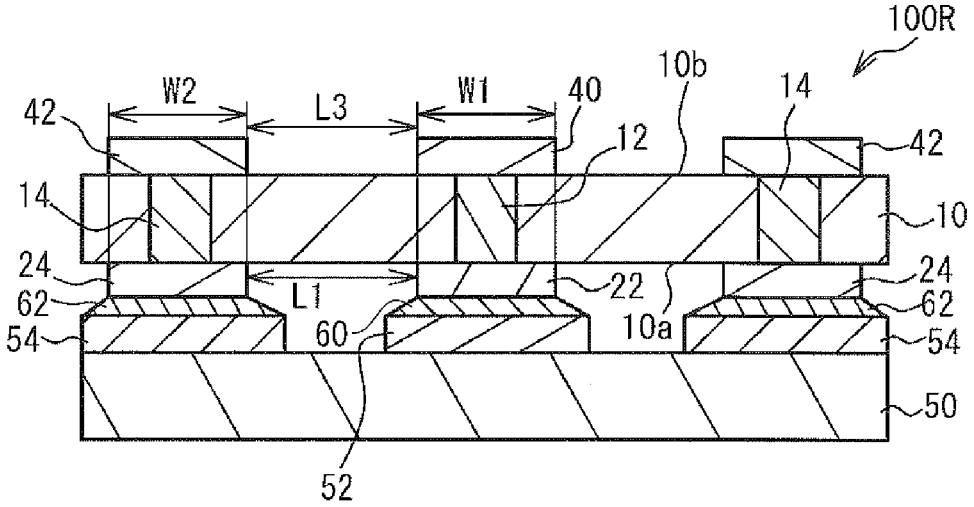
FIG. 3B is a sectional view taken along line A-A of FIG. 3A.

The comparative example will be described. FIG. 3A is a plan view illustrating a second surface 10*b* of a flexible substrate 100R according to the comparative example. FIG. 3B is a sectional view taken along line A-A of FIG. 3A. Further, a first surface 10*a* of the flexible substrate 100R is the same as that of FIG. 1A, so that illustration thereof will be omitted.

As shown in FIGS. 3A and 3B, the width of the conductor pattern 40 according to the comparative example is narrower than the width of the conductor pattern 40 according to the first embodiment, and is equal to the width W1 of the signal line 22 shown in FIG. 3B. The width of the ground pattern 42 according to the comparative example is narrower than the width of the ground pattern 42 according to the first embodiment, and is equal to the width W2 of the ground pattern 24 shown in FIG. 3B. A distance L3 (FIG. 3B) between the conductor pattern 40 and the ground pattern 42 according to the comparative example is larger than the distance L2 (FIG. 2B) according to the first embodiment and is equal to the distance L1 (FIG. 3B) according to the first embodiment.

Figure 4A:
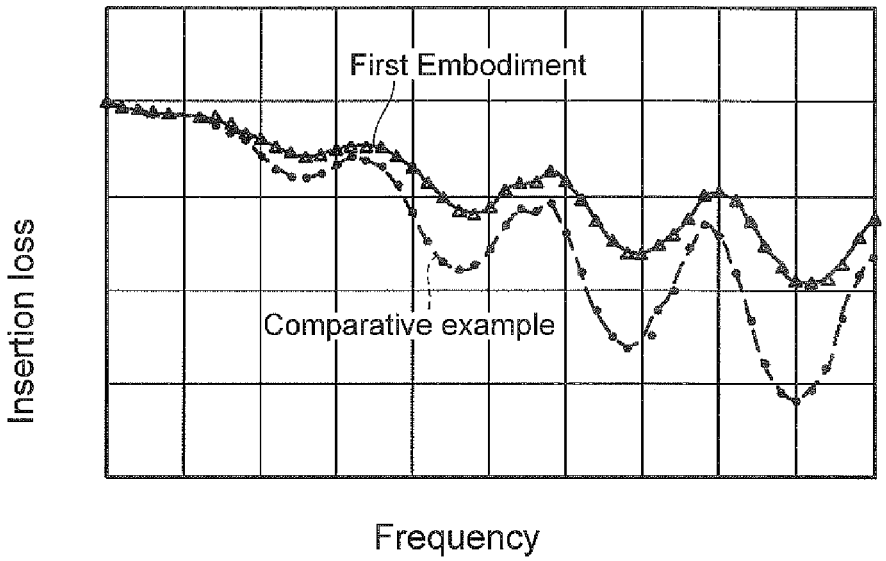
FIG. 4A is a graph illustrating a calculation result of an insertion loss.
Figure 4B:
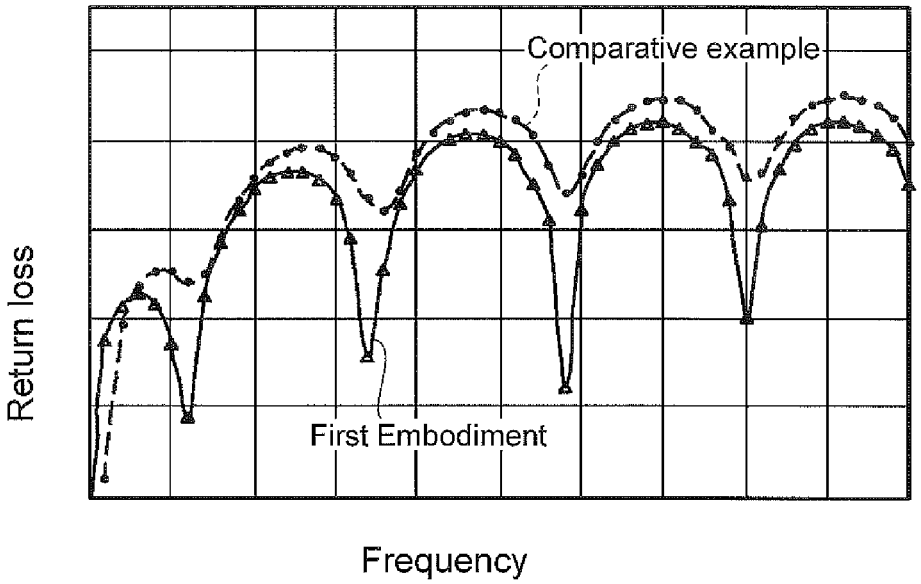
FIG. 4B is a graph illustrating a calculation result of a return loss.

A transmission characteristic and a reflection characteristic in the first embodiment and the comparative example were simulated. In the simulation, a frequency of a signal was changed, and an insertion loss of the signal and a return loss of an input signal were calculated. FIG. 4A is a graph illustrating a calculation result of an insertion loss, and FIG. 4B is a graph illustrating a calculation result of a return loss. Horizontal axes of FIGS. 4A and 4B denote frequencies, a vertical axis of FIG. 4A denotes an insertion loss, and a vertical axis of FIG. 4B denotes a return loss. A line configured by a solid line and triangles implies a result according to the first embodiment, and a line configured by a dotted line and circles implies a result according to the comparative example. Further, each axis corresponds to predetermined coordinates.

As shown in FIG. 4A, the insertion loss according to the first embodiment is smaller than the insertion loss according to the comparative example. Further, according to the first embodiment, a change (undulation) in the insertion loss according to the change in the frequency is decreased. As shown in FIG. 4B, the return loss according to the first embodiment is smaller than the return loss according to the comparative example. As described above, the transmission characteristic and the reflection characteristic are improved according to the first embodiment.

Second Embodiment

Figure 5A:
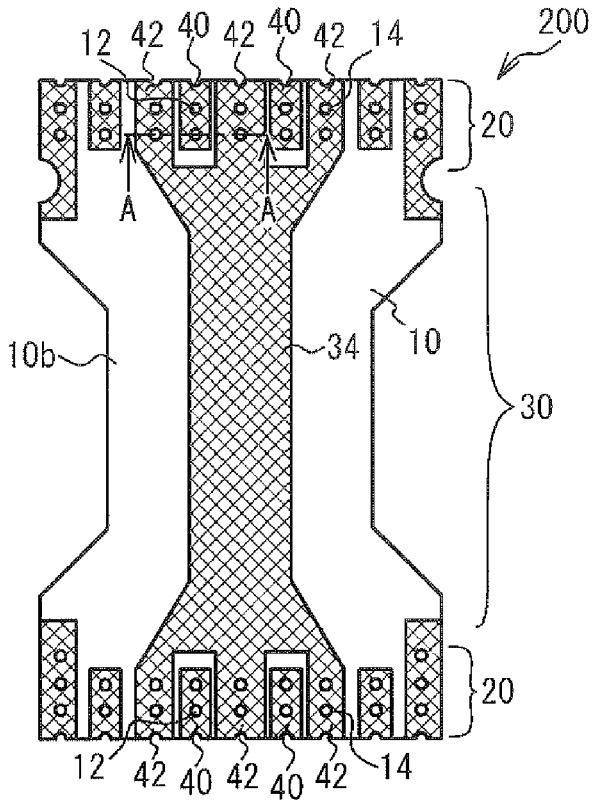
FIG. 5A is a plan view illustrating a second surface of a flexible substrate according to a second embodiment.
Figure 5B:
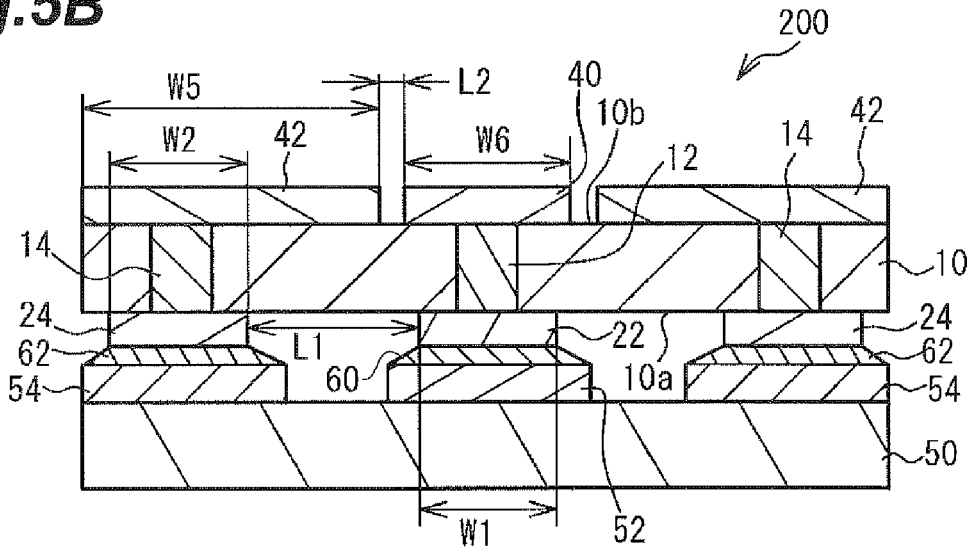
FIG. 5B is a sectional view taken along line A-A of FIG. 5A.

A second embodiment corresponds to an example where a width of the ground pattern 42 is wider than that of the first embodiment and where a width of the conductor pattern 40 is smaller than that of the first embodiment. FIG. 5A is a plan view illustrating a second surface 10*b* of a flexible substrate 200 according to a second embodiment. FIG. 5B is a sectional view taken along line A-A of FIG. 5A. Further, a first surface 10*a* (FIG. 5B) of the flexible substrate 200 is the same as that of FIG. 1A, so that illustration thereof will be omitted.

As shown in FIGS. 5A and 5B, the width of the ground pattern 42 is wider than that of the first embodiment. As shown in FIG. 5B, the width W5 of the ground pattern 42 is wider than the width W2 of the ground pattern 24, and is equal to, for example, 0.6 mm. The width W6 of the conductor pattern 40 is wider than the width W1 of the signal line 22, and is equal to, for example, 0.5 mm. The distance L2 is equal to, for example, 0.1 mm. According to the second embodiment, since the distance L2 is smaller than the distance LL the characteristic impedance of the coplanar line 20 (FIG. 5A) can be decreased. That is, according to the second embodiment, the desired characteristic impedance can be achieved and the bond strength can be improved at the same time.

As described in the first and second embodiments, the smaller the distance L2 is, the lower the characteristic impedance of the coplanar line 20 can be. In order to narrow the distance L2, the width of the conductor pattern 40 may be extended, or the width of the ground pattern 42 may be extended. Further, the widths of both the conductor pattern 40 and the ground pattern 42 may be extended.

Third Embodiment

Figure 6:
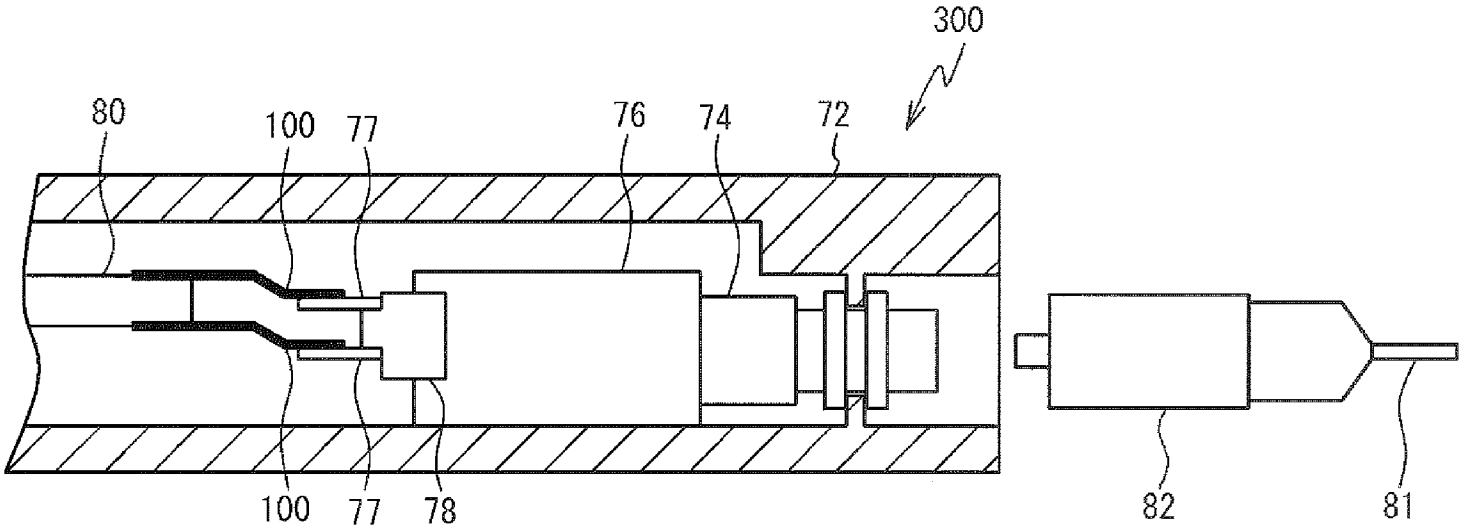
FIG. 6 schematically illustrates a module according to a third embodiment.

A third embodiment corresponds to an example where the first embodiment or the second embodiment is applied to an optical module. FIG. 6 schematically illustrates an optical module 300 according to a third embodiment. FIG. 6 illustrates a sectional surface of a housing 72, and a side surface of other components. In the housing 72, a receptacle 74, a housing 76, a lead pin 77, an insulator 78, a flexible substrate 100, and a circuit substrate 80 are installed. A connector 82 to which an optical fiber 81 is connected is inserted into the receptacle 74. In the housing 76, a light reception element such as a photo diode or the like and a pre-amplifier (not illustrated) for amplifying an output of the light reception element are installed. In the insulator 78, a line for transferring an electric signal or electric power is provided. An optical signal input from the optical fiber 81 is converted into an electric signal by the light reception element and is amplified by the pre-amplifier in the housing 76. The amplified electric signal is transferred to the circuit substrate 80 through the line of the insulator 78, the lead pin 77, and the flexible substrate 100. The flexible substrate 100 mainly supplies Direct Current (DC) electric power to the housing 76. A high frequency signal is transmitted and received between an interior of the housing 76 and the circuit substrate 80 through the flexible substrate 100.

Further, in the housing 76, a light emission element such as a laser diode or the like and a driving circuit for driving the light emission element are installed. An electric signal is transferred from the circuit substrate 80 through the flexible substrate 100, the lead pin 77, and the line of the insulator 78 to the driving circuit. The driving circuit amplifies the electric signal. The laser diode converts the amplified electric signal into an optical signal, and outputs a laser beam to the optical fiber 81.

According to the third embodiment, the optical module 300 includes the flexible substrate 100 and an optical element. The optical element has the lead pin 77 for receiving an input signal or transmitting an output signal. The signal line 22 of the flexible substrate 100 is connected to the lead pin 77 and the circuit substrate 80. As described above in the first embodiment, the bond strength between the flexible substrate 100 and the lead pin 77, and between the flexible substrate 100 and the circuit substrate 80 is improved. The characteristic impedance of the coplanar line 20 may be configured to have a desired value. The flexible substrate 200 may be applied to the optical module 300.

What is claimed is:

1. A flexible substrate comprising:

an insulating substrate having a first surface and a second surface opposite to the first surface, the insulating substrate including resin;

a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor;

a conductor pattern formed on the second surface, the conductor pattern being connected to the first conductor through a first via wire which passes through the insulating substrate;

a third ground pattern formed on the second surface, the third ground pattern being connected to the first ground pattern through a second via wire which passes through the insulating substrate; and a microstrip line including a line conductor on the first surface of the insulating substrate and a fourth ground pattern on the second surface of the insulating substrate, wherein a distance between the conductor pattern and the third ground pattern is smaller than a distance between the first conductor and the first ground pattern, wherein the line conductor is connected to the first conductor, and wherein a width of the third ground pattern is wider than a width of the first ground pattern.

2. The flexible substrate according to claim 1, wherein a width of the conductor pattern is wider than a width of the first conductor.

3. The flexible substrate according to claim 1, wherein the third ground pattern is connected to the second ground pattern through a third via wire which passes through the insulating substrate.

4. The flexible substrate according to claim 1, wherein the first conductor is connected to a first electrode of the external conductor, and wherein the first ground pattern is connected to a second electrode of the external conductor.

5. The flexible substrate according to claim 1, wherein the first conductor has an end portion thereof having a width that is wider than a width of a middle portion of the first conductor.

6. The flexible substrate according to claim 1, further comprising a second connection portion having a second conductor, the second ground pattern, and a fifth ground pattern on the first surface of the insulating substrate, wherein the second ground pattern and the fifth ground pattern is spaced apart from the second conductor and respectively located at opposite sides of the second conductor, and wherein the second ground pattern is located between the first conductor and the second conductor.

7. The flexible substrate according to claim 6, wherein a second coplanar line is constituted by the second conductor, the second ground pattern, and the fifth ground pattern.

8. The flexible substrate according to claim 6, wherein the second conductor has an end portion thereof having a width that is wider than a width of a middle portion of the second conductor.

9. The flexible substrate according to claim 1, wherein a first coplanar line is constituted by the first conductor, the first ground pattern, and the second ground pattern.

10. A flexible substrate comprising:

an insulating substrate having a first surface and a second surface opposite to the first surface, the insulating substrate including resin;

a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor;

a conductor pattern formed on the second surface, the conductor pattern being connected to the first conductor through a first via wire which passes through the insulating substrate; and a third ground pattern formed on the second surface, the third ground pattern being connected to the first ground pattern through a second via wire which passes through the insulating substrate, wherein a distance between the conductor pattern and the third ground pattern is smaller than a distance between the first conductor and the first ground pattern, and wherein a width of the conductor pattern is wider than a width of the first conductor.

11. The flexible substrate according to claim 10, wherein the first conductor has an end portion thereof having a width that is wider than a width of a middle portion of the first conductor.

12. The flexible substrate according to claim 10, wherein a first coplanar line is constituted by the first conductor, the first ground pattern, and the second ground pattern.

13. The flexible substrate according to claim 10, wherein the third ground pattern is connected to the second ground pattern through a third via wire which passes through the insulating substrate.

14. The flexible substrate according to claim 10, wherein a width of the third ground pattern is wider than a width of the first ground pattern.

15. The flexible substrate according to claim 10, wherein the first conductor is connected to a first electrode of the external conductor, and wherein the first ground pattern is connected to a second electrode of the external conductor.

16. The flexible substrate according to claim 10, further comprising a second connection portion having a second conductor, the second ground pattern, and a fifth ground pattern on the first surface of the insulating substrate, wherein the second ground pattern and the fifth ground pattern are spaced apart from the second conductor and respectively located at opposite sides of the second conductor, and wherein the second ground pattern is located between the first conductor and the second conductor.

17. The flexible substrate according to claim 16, wherein a second coplanar line is constituted by the second conductor, the second ground pattern, and the fifth ground pattern.

18. The flexible substrate according to claim 16, wherein the second conductor has an end portion thereof having a width that is wider than a width of a middle portion of the second conductor.

19. A flexible substrate comprising:

an insulating substrate having a first surface and a second surface opposite to the first surface, the insulating substrate including resin;

a first connection portion configured to be connected with an external conductor and having a first conductor, a first ground pattern, and a second ground pattern on the first surface, the first ground pattern and the second ground pattern being spaced apart from the first conductor and respectively located at opposite sides of the first conductor;

a conductor pattern formed on the second surface, the conductor pattern being connected to the first conductor through a first via wire which passes through the insulating substrate;

a third ground pattern formed on the second surface, the third ground pattern being connected to the first ground pattern through a second via wire which passes through the insulating substrate; and a microstrip line including a line conductor on the first surface of the insulating substrate and a fourth ground pattern on the second surface of the insulating substrate, wherein a distance between the conductor pattern and the third ground pattern is smaller than a distance between the first conductor and the first ground pattern, wherein the line conductor is connected to the first conductor, and wherein a width of the conductor pattern is wider than a width of the first conductor.

* * * * *